US006173682B1

(12) United States Patent
Parnell et al.

(10) Patent No.: US 6,173,682 B1
(45) Date of Patent: Jan. 16, 2001

(54) TUBESHEET AND TUBE PROTECTOR DEVICE AND A METHOD FOR MAKING SUCH A DEVICE

(75) Inventors: David C. Parnell, Dallas; James E. Lewis, Plano, both of TX (US)

(73) Assignee: Koch TPA, Inc., Dallas, TX (US)

( * ) Notice: Under 35 U.S.C. 154(b), the term of this patent shall be extended for 0 days.

(21) Appl. No.: 09/310,266

(22) Filed: May 12, 1999

(51) Int. Cl.[7] ..... F22B 17/02

(52) U.S. Cl. ..... 122/512; 122/511; 122/DIG. 13; 165/134.1

(58) Field of Search ..... 122/511, 512, 122/DIG. 13; 165/134.1; 110/322, 323

(56) References Cited

U.S. PATENT DOCUMENTS 4,936,260 * 6/1990 Adams ..... 122/18.31

OTHER PUBLICATIONS

"Sulfur Recovery," presented at the Annual TPA, Inc. Sulfur Seminar, Dallas, Texas, May, 1997.

Blasch Precision Ceramics Bulletin, 1 page, Albany, New York, 1995.

The Blasch Precision Ceramics Hex Head Furrule System, 1 page, Albany New York, 1997.

Industrial Ceramics Limited Product Information Bulletin Two Part Hexagon Ferrule, 1 page, Ontario, Canads 1991.

Industrial Ceramics Limited Product Information Belletin Two Part Hexagon Ferrule, 1 page, Ontario, Canada, 1991.

* cited by examiner

*Primary Examiner*—Denise L. Ferensic
*Assistant Examiner*—Jiping Lu
(74) *Attorney, Agent, or Firm*—Shook, Hardy & Bacon LLP

(57) ABSTRACT

A tubesheet protector device is provided for use with a boiler having at least one tube for receiving a fluid extending therethrough. The tubes extend approximately perpendicularly from a tubesheet covering an inlet of the boiler. The tubesheet protector device includes insulating board mounted on the tubesheet having holes therein for receiving ferrules. Each ferrule includes a shank adapted to be received in one of the tubes and a polygon-headed collar coupled with the shank. Both the collar and the shank of the ferrule are wrapped in insulation. The collar has dimensions larger than the outside diameter of the tube, and the collar and the shank both have a common through bore for transporting fluid from outside the boiler to the interior of the tubes extending through the boiler.

27 Claims, 2 Drawing Sheets

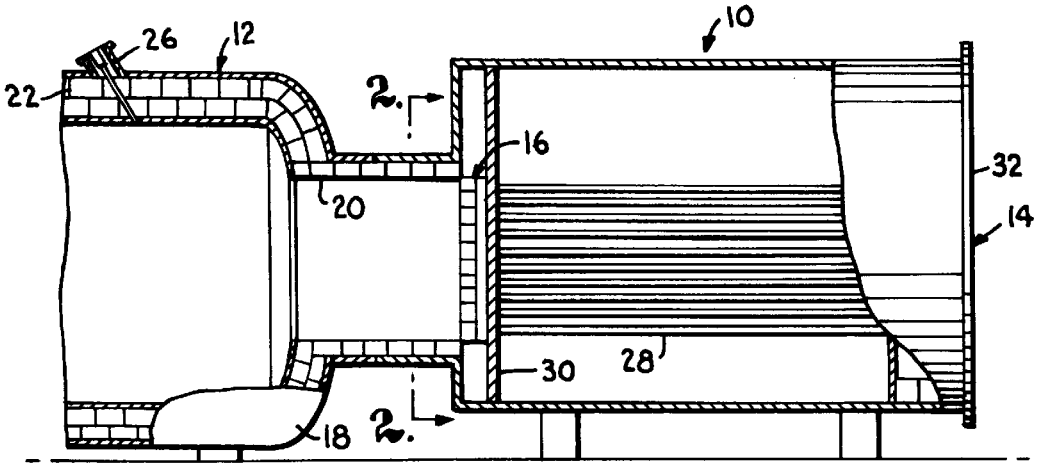
Fig. 1.
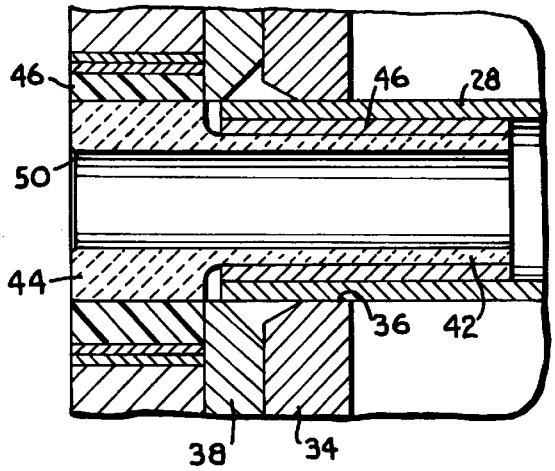
Fig. 4.
Fig. 2.
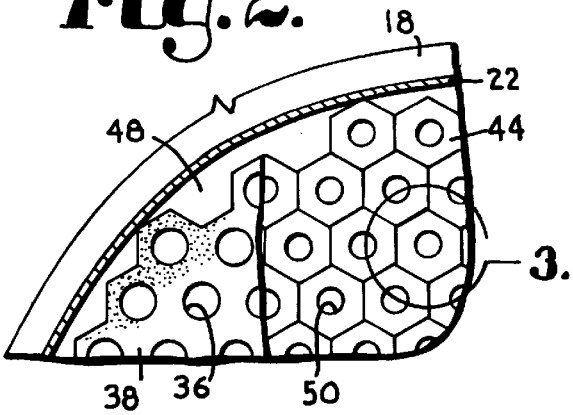
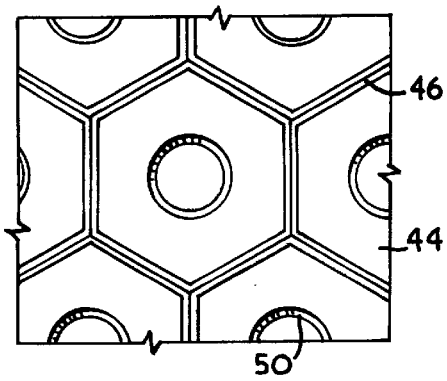
Fig. 3.

Fig. 5.
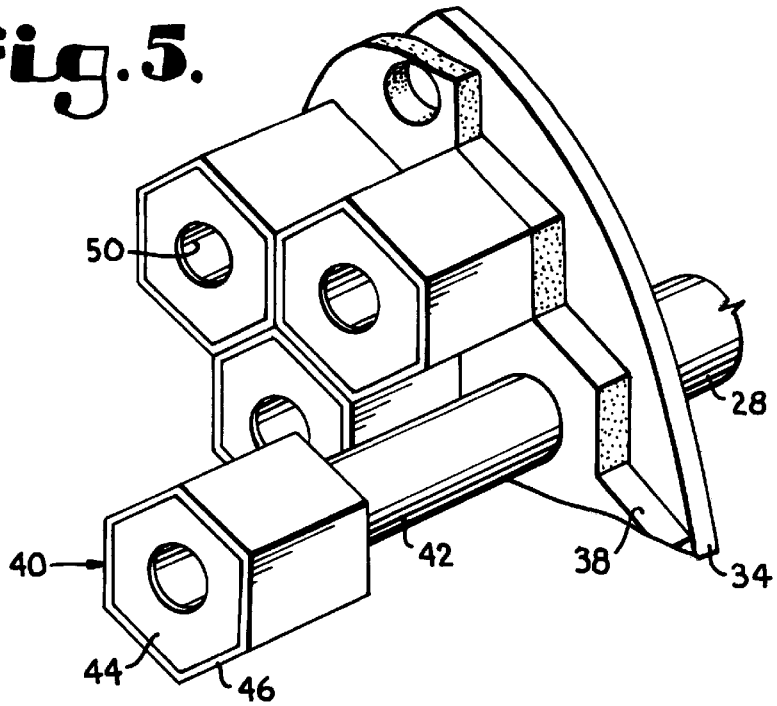
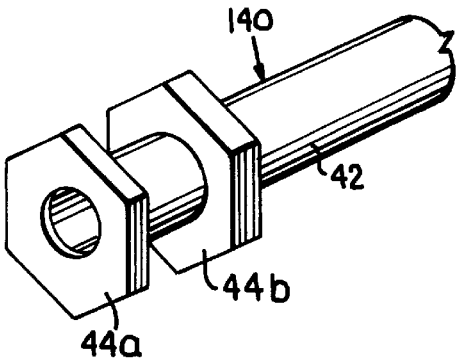
Fig. 6.
Fig. 7.
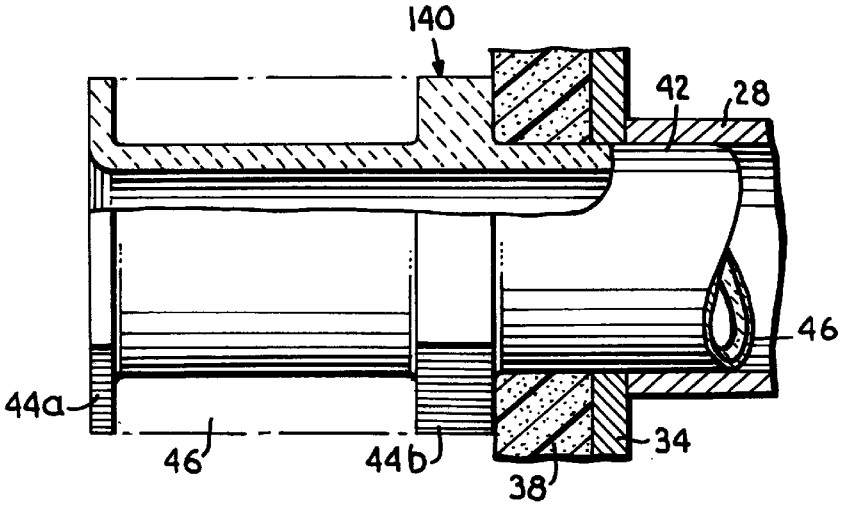

TUBESHEET AND TUBE PROTECTOR DEVICE AND A METHOD FOR MAKING SUCH A DEVICE

CROSS-REFERENCE TO RELATED APPLICATIONS

Not applicable.

BACKGROUND OF THE INVENTION

This invention relates to a tubesheet and tube protector device. More specifically, this invention relates to insulating board and insulated ferrules to be used in a vessel having at least one tube for receiving a fluid extending through the tubesheet.

Conventional tube and tubesheet protector devices include ferrules having round collars connected to shanks. The shanks of the ferrules are inserted into tubes that extend from a tubesheet which covers the inlet of a vessel. To fill the gaps that form between ferrules when the round collars of the ferrules are next to each other and covering part of the tubesheet, the ferrules are installed using a castable or plastic refractory lining that is anchored with stainless steel anchors. By using a castable or plastic refractory lining, the interstices between ferrules are filled so that the entire tubesheet is covered. The shanks of conventional ferrules are wrapped with insulation. However, the round collars of conventional ferrules are not usually wrapped with insulation.

One disadvantage with conventional tubesheet and tube protector devices is that there is insufficient insulation between the collars of the ferrules and the anchors. Thus, anchors and ferrules, especially those in the center of the tubesheet, become damaged or effectively destroyed when the vessel operates at high temperatures. Such devices are especially insufficient for vessels that run with oxygen enriched air because of the high temperatures attained by these vessels.

Another disadvantage with conventional tubesheet protector devices is that ferrules cannot easily be removed and replaced individually because they are installed by being surrounded with a castable or plastic refractory. This is a costly problem because ferrules must be replaced periodically as a result of becoming damaged or destroyed. In addition, damage to the ferrules usually results in severe damage to both the tubes and tubesheet. The net result of this ferrule damage is an expensive re-tubing repair. Still another disadvantage with conventional tube and tubesheet protector devices is that such devices require significant amounts of castable or plastic refractory that must be filled between the interstices formed by the round ferrule collars.

In order to overcome these disadvantages, a tubesheet protector device that provides better insulation than the current conventional devices is needed. This device should be able to withstand high temperatures and preferably should have ferrules that can be replaced individually.

SUMMARY OF THE INVENTION

It is an object of the present invention to provide both a tubesheet and tube protector device having ferrules that can be conveniently removed individually in order to provide better access when either repairing or replacing a single ferrule.

A further object of the present invention is to provide a tubesheet and tube protector device including ferrules having insulated collars and shanks thus providing additional insulation to the entire installation.

Another object of the present invention is to provide better insulation for the tubes and tubesheet of a vessel so that the vessel may safely operate at temperatures up to and including at least about 3000° F. (1649° C.).

A further object of the present invention is to provide a tubesheet protector device that includes virtually no castable or plastic refractory and necessitates no anchors so that the ferrules may be installed easily and with reduced installation time.

Still a further object of the present invention is to provide a tubesheet protector device with ferrules that are shaped so as to fit together and form a seal over insulation board covering the tubesheet.

According to the present invention, the foregoing and other objects are achieved by a tubesheet protector device for use in a boiler having tubes for receiving a fluid extending through the tubesheet. The tubesheet and tube protector device includes an insulating board mounted on a tubesheet that covers the inlet of the boiler. Still further, it includes insulation wrapped ferrules each having a polygon-headed collar that is coupled with a shank. The collars may or may not be integral with the shank. The polygon-headed ferrules are inserted through the insulating board and into the tubes, which extend from the tubesheet. Each shank is received by the tubes in the boiler. Both the collar and the shank have a common through bore for transporting fluid from the reactor to the interior of the tubes extending through the boiler.

Additional objects, advantages and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

FIG. 1 is a side elevational view, with portions broken away and shown in cross section, of a reactor and boiler with a tubesheet and tube protector device of the preferred embodiment of the present invention;

FIG. 2 is an enlarged detached cross-sectional view of the tubesheet and tube protector device taken generally along line 2—2 of FIG. 1;

FIG. 3 is an enlarged fragmentary view of the tubesheet and tube protector device within the captured region (3) of FIG. 2;

FIG. 4 is an enlarged detached cross-sectional view of a ferrule which is part of the tubesheet and tube protector device of the preferred embodiment of the present invention;

FIG. 5 is a fragmentary perspective view of the tubesheet and tube protector device of the preferred embodiment with parts being broken away to show details of construction;

FIG. 6 is a perspective view of a ferrule of the present invention; and

FIG. 7 is a side-elevational view of a ferrule that is part of the tubesheet and tube protector device of the present invention with parts being broken away to show details of construction.

DETAILED DESCRIPTION OF THE INVENTION

Referring to FIG. 1, apparatus embodying the principles of this invention is broadly designated by the reference numeral 10. Apparatus 10 typically comprises a reactor 12 and a boiler 14 with a tube and tubesheet protector device 16. Reactor 12 has a shell 18 and an outlet 20. The interior of shell 18 is lined with refractory bricks 22. Multiple gas inlet nozzles 26 communicate with the interior of shell 18.

Outlet 20 of reactor 12 is attached to boiler 14. A plurality of tubes 28 extend from inlet 30 of boiler 14 to outlet 32. At the inlet 30 end of boiler 14, a tube and tubesheet protector device 16 is coupled with tubes 28. Tube and tubesheet protector device 16 includes a tubesheet 34 having holes 36 therein, as shown in FIG. 4. Tubes 28 are integral with tubesheet 34. The outer side of tubesheet 34 is covered with insulating board 38 (see FIG. 2) having a plurality of holes therein. A plurality of ferrules 40 are received by insulating board 38 and tubes 28, which extend from tubesheet 34, as shown in more detail in FIG. 5. Ferrules 40 in combination with insulating board 38 and tubesheet 34 form the tube and tubesheet protector device 16 of the present invention.

An individual ferrule 40 is shown in more detail in FIG. 5. Each ferrule 40 is comprised of a shank 42 and a collar 44. Shank 42 and collar 44 may be separate pieces that are fitted together or they may be cast as a single piece. Alternatively, ferrule 140, which is shown in FIGS. 6 and 7, is comprised of a distal collar 44*a* and an intermediate collar 44*b*. Both shank 42 and collar 44 are wrapped in insulation 46, as shown in FIGS. 3, 4, and 5. Where ferrule 140 has both a distal collar 44*a* and an intermediate collar 44*b*, insulation 46 should be wrapped around each collar and the area between the collars, as shown in FIG. 7.

Each shank 42 fits through a hole 36 in insulating board 38 and into a tube 28. The ferrules 40 have collars 44 presenting surfaces which fit tightly together in a closely mated sealing relationship. These collars are shown as being hexagonally shaped in FIGS. 2, 3, 5, and 6. Ferrules 40 fit tightly together, so as to form a seal over insulating board 38, as shown in FIGS. 2, 3, and 5. A castable or plastic refractory 48 is used to fill the outer peripheral areas where the ferrule collars do not fit tightly against the interior of refractory bricks 22, as shown in FIG. 2. Ferrules 40 have bores 50, as shown in FIGS. 2–5, extending therethrough for transporting fluid from reactor 12 to the inside of tubes 28 in boiler 14.

The tubesheet protector device of the present invention is made by cutting holes in insulating board 38 for each tube 28 extending through boiler 14. Insulating board 38 is then placed over tubesheet 34, and the holes 36 in insulating board 38 are aligned with the tubes projecting from tubesheet 34. An adhesive, such as glue or mastic, may be placed between board 38 and tubesheet 34 so as to mount board 38 on the tubesheet 34. Alternately, the board can be impaled on short spikes welded to the tubesheet. Preferably, the spikes are used in combination with the use of mastic. Collar 44 and shank 42 of each polygon-headed ferrule 40 is wrapped with insulation 46. Shank 42 of each polygon-headed ferrule 40 is inserted through insulating board 38 and into each tube 28.

In operation, fluid is received by bores 50 of ferrules 40. Fluid flows through shank 42 and into tubes 28. Tubes 28 may be exposed to various physical conditions, such as high temperatures. Fluid flows through tubes 28 which extend through boiler 14.

Collars 44 of ferrules 40 should be shaped so as to fit tightly together and form a seal over insulating board 38. The collars extend radially outwardly from the shanks and each presents an edge spaced radially from the shank. This edge includes a sealing surface. The collar may be shaped as any polygon or any other shape that fits together with another collar without the use of a castable or plastic refractory between ferrules. The sealing surfaces of the collars should be disposed in a closely mated sealing relationship relative to one another. Preferably, the collars are the same size and the same shape. Still further, preferably, the collars are equilateral. Preferably, the collars are polygonal in shape. Most preferably, collars 44 are shaped as equilateral hexagons and interlock to form a honeycomb structure, which functions as a seal over insulating board 38.

The ferrules 40 may be made of ceramics or other materials that are able to withstand temperatures up to and including at least about 3000° F. (1649° C.) and pressures up to and including at least about 50 psig. Preferably, they are comprised of about 90% aluminum oxide. Collar 44 and shank 42 of ferrule 40 may be cast as a single piece, or the collar and the shank may be separate pieces. If the collar 44 and the shank 42 are separate pieces, they may be frictionally fitted together or some castable refractory may be used to secure collar 44 to shank 42. The inside surface of ferrule shank 42 may be chamfered.

Each ferrule 40 may be removed and replaced individually by any method capable of removing the ferrules. For example, ferrule 40 may be removed by putting an extraction device into bore 50, engaging the inner surface of the ferrule, and pulling.

Both the collar 44 and the shank 42 of each ferrule 40 are wrapped in insulation 46 A high temperature ceramic fiber paper or an insulating blanket may be used as the insulation. The paper should be between 1/32 and 1 inch thick. Preferably, it is between 3/16 and 1/4 inches thick. The insulating material may be comprised of aluminum oxide, silicon oxide, sodium oxide, and iron oxide. One example of an acceptable paper includes 54.8% aluminum oxide, 44.0% silicon oxide and 0.2% sodium oxide. While it can be made of less than 50% aluminum oxide, preferably, it is comprised of at least about 50% aluminum oxide. Most preferably, it is comprised of at least about 90% aluminum oxide. Preferably, the ceramic fiber paper has a thermal conductivity no greater than 1.6 BTU-in/hr $ft^2$ ° F. measured at 2000° F. Preferably, the paper has a melting point that is at least about 3600° F. Preferably, the paper has a continuous use temperature of at least about 2800° F. Preferably, the paper is heat treated to remove any absorbed water and/or organic material before being used.

Insulating board 38 should be able to withstand high temperatures. It is primarily comprised of aluminum oxide and silicon oxide. Preferably, the insulating board is at least about 66% aluminum oxide. Most preferably, it is at least about 81% aluminum oxide. Either an organic or inorganic binder may be employed in constructing board 38, but an organic binder is preferred. Preferably, the insulating board is about 0.5 to 1.5 inches thick. Preferably, it has a maximum temperature rating of at least at least about 3000° F., continuous use temperature of at least about 2800° F., and a thermal conductivity no greater than 2.1 BTU-in/hr $ft^2$ ° F. measured at 2500° F. Typically, the tubesheet 34, upon which insulating board 38 is mounted, is comprised of either high grade carbon steel, such as SA-516-70, or stainless steel (300 series or austenitic).

The ligament length, which is the distance between the outer surfaces of adjacent tubes, will vary depending on the diameter of tubes 28 used and the operating parameters of boiler 14. In many cases, where a plurality of holes are cut in insulating board 38, the ligament length is at least about 3/4 of an inch between the outer surface of the holes. Preferably, the ligament length is at least about 1 inch between holes but not less than 0.5 inches. Larger ligament lengths provide sufficient physical integrity for board 38 to be placed on tubesheet 34 without breaking or being damaging. Larger ligament lengths also provide better hydraulic flow characteristics on the boiler shell inlet side because tubes 28 are spaced farther apart. Specifically, water flow to tubes 28 and steam disengaging around tubes 28 will be improved by greater distances between tubes 28.

Preferably, the tubesheet protector device system of the present invention is able to withstand temperatures up to and including at least about 3000° F. and pressures up to and including at least about 50 psig. The tubesheet protector device of the present invention may be used in vessels that have at least one tube extending through the tubesheet. It may be used as a part of a tubular reactor, a shell and tube heat exchanger, or a tubular heat exchanger, where a tube is exposed to thermal radiation and heat transfer from combustion gases. For example, it may be used for insulation in a Claus unit, where hydrogen sulfide is oxidized to give sulfur dioxide which is then combined with additional hydrogen sulfide to produce elemental sulfur. More specifically, the Claus sulfur plant boiler may be for air only, oxygen enhanced air, or for total oxygen units.

Whether the vessel has a single tube or a plurality of tubes will depend on the chosen application. Radial temperature gradients can be minimized by the use of multiple tubes having smaller diameters.

It takes less time to install the tubesheet protector device of the present invention than it does to install conventional systems because the device of the present invention does not require refractory anchors and requires virtually no castable refractory. Still further, this device can be installed more accurately than conventional castable lining systems because there is less chance for error. Still further, better consistency and overall quality control are obtained with the tubesheet protector device of the present invention. Furthermore, the tubesheet protector device of the present invention increases the reliability and service life of the boiler. It is especially useful for plants using oxygen that reaches high temperatures, such as a Claus unit.

From the foregoing, it will be seen that this invention is one well adapted to attain all the ends and objects hereinabove set forth together with other advantages which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

We claim:

1. A tubesheet protector device for use with high temperature gases in a boiler having at least one tube extending from a tubesheet which is approximately perpendicular to the axis of the tube, said device comprising:

a shank adapted to be received in said tube;

a polygonal collar coupled with said shank, said collar having dimensions larger than the outside diameter of said tube, and said collar and said shank both having a common through bore for transporting fluid from outside said boiler to the interior of said tube; and insulating board mounted on said tubesheet wherein said insulating board has a hole therein for receiving said shank, and wherein said insulating board is comprised of silicone oxide (silica) and at least about 66% aluminum oxide (alumina) and has a thermal conductivity no greater than 2.1 BTU-in/hr ft$^{2}$° F. measured at 2500° F.

2. The device of claim 1, wherein said shank and said collar are wrapped in insulation.

3. The device of claim 2, wherein said insulation is insulating ceramic fiber paper or ceramic fiber blanket.

4. The device of claim 3, wherein said insulation is comprised of aluminum oxide, silicon oxide, and sodium oxide.

5. The device of claim 4, wherein said insulation has a thermal conductivity not greater than 1.6 BTU-in/hr ft$^{2}$ ° F. measured at 2000° F.

6. The device of claim 2, wherein said insulation is a blanket-style or paper-style insulating wrap.

7. The device of claim 1, wherein said shank and said collar are cast as a single piece.

8. The device of claim 1, wherein said collar is frictionally secured to said shank.

9. The device of claim 1, wherein said collar has an equilateral hexagonal shape.

10. The device of claim 1, wherein said collar coupled with said shank forms a ferrule and wherein said tubesheet and said insulating board each have a plurality of holes therein which are aligned with one another for receiving a plurality of said ferrules.

11. The device of claim 10, wherein said collars of said ferrules are shaped so as to fit together and form a seal over said insulating board.

12. The device of claim 11, wherein said tubesheet protector device is able to withstand temperatures up to and including at least about 3000° F. (1649° C.).

13. The device of claim 12, wherein said tubesheet protector device is able to withstand pressures of up to and including at least about 50 psig.

14. A tubesheet protector device for use with a boiler having an inlet and an outlet and at least two tubes extending from a tubesheet covering said inlet, comprising:

at least two elongated shanks adapted to be received in said tubes;

at least two collars extending radially outwardly from each of said shanks adjacent on end thereof to present an edge spaced radially from said shank, said edge including a sealing surface, wherein said tubes are positioned so that the sealing surfaces of said collars are disposed in a closely mated sealing relationship relative to one another; and insulating board mounted on said tubesheet wherein said insulating board has at least two holes therein for receiving said shanks, and wherein said insulating board is comprised of silicone oxide (silica) and at least about 66% aluminum oxide (alumina) and has a thermal conductivity no greater than 2.1 BTU-in/hr ft$^{2}$ ° F. measured at 2500° F.

15. The device of claim 14, wherein said shanks and said collars are wrapped in insulation.

16. The device of claim 15, wherein said tubesheet protector device is able to withstand temperatures up to and including at least about 3000° F. (1649° C.) and is able to withstand pressures up to and including at least about 50 psig.

17. A device for receiving a fluid, said device comprising:

a vessel having an inlet and an outlet;

at least one tube extending through said vessel from said inlet to said outlet;

a tubesheet closing said inlet and having a hole therein for connecting said tube to said tubesheet at said inlet;

an insulating board mounted on said tubesheet;

a polygon-headed ferrule comprised of a shank and adapted to be received in said tube at said inlet, said ferrule having a collar of larger dimensions than the outside diameter of said shank, whereby said insulating board is sandwiched between said collar and said tubesheet, wherein said shank and said collar of said ferrule have a common through bore for transporting fluid from outside said vessel to the interior of said tube, and wherein said insulating board is comprised of silicone oxide (silica) and at least about 66% aluminum oxide (alumina) and has a thermal conductivity no greater than 2.1 BTU-in/hr $ft^2$ ° F. measured at 2500° F.

18. The device of claim 17, wherein said device is able to withstand temperatures up to and including about 3000° F.

19. The device of claim 18, wherein said device is able to withstand pressures up to and including at least about 50 psig.

20. The device of claim 17, wherein said device is comprised of a plurality of tubes and a plurality of ferrules extending into said tubes.

21. The device of claim 20, wherein both said collars and said shanks of said ferrules are wrapped in insulation.

22. The device of claim 21, wherein each of said collars of said ferrules is an equilateral hexagonal shape of the same size and wherein said collars fit together to form a seal over said insulating board.

23. The device of claim 21, wherein said ferrules may be replaced individually.

24. The device of claim 23, wherein said tubesheet is comprised of high grade carbon steel and said board is comprised of ceramic fiber.

25. A method for insulating a tubesheet covering an inlet of a boiler, wherein a tube extends from said tubesheet into said boiler, comprising:

cutting at least one hole in insulating board;

mounting said insulating board on said tubesheet; and inserting a polygon-headed ferrule, comprised of a shank that is integral with a polygon shaped collar, through said hole in said insulating board and into said tube, and wherein said insulating board is comprised of silicone oxide (silica) and at least about 66% aluminum oxide (alumina) and has a thermal conductivity no greater than 2.1 BTU-in/hr $ft^2$ ° F. measured at 2500° F.

26. The method of claim 25, further comprising:

wrapping said collar and said shank of said ferrule in insulation before inserting said ferrule into said tube.

27. The method of claim 26, further comprising:

placing an adhesive between said insulating board and said tubesheet.

* * * * *